US009951784B2

(12) United States Patent
Agrawal et al.

(10) Patent No.: US 9,951,784 B2
(45) Date of Patent: Apr. 24, 2018

(54) MECHANICALLY-COUPLED TURBOMACHINERY CONFIGURATIONS AND COOLING METHODS FOR HERMETICALLY-SEALED HIGH-TEMPERATURE OPERATION

(75) Inventors: Giridhari L. Agrawal, Simsbury, CT (US); Charles W. Buckley, West Hartford, CT (US); Muthusamy Rajendran, Manchester, CT (US)

(73) Assignee: R&D Dynamics Corporation, Bloomfield, CT (US)

( * ) Notice: Subject to any disclaimer, the term of this patent is extended or adjusted under 35 U.S.C. 154(b) by 1622 days.

(21) Appl. No.: 13/191,979

(22) Filed: Jul. 27, 2011

(65) Prior Publication Data

US 2012/0027567 A1 Feb. 2, 2012

Related U.S. Application Data

(60) Provisional application No. 61/368,037, filed on Jul. 27, 2010.

(51) Int. Cl.
*F04D 25/02* (2006.01)
*F04D 29/04* (2006.01)
(Continued)

(52) U.S. Cl.
CPC ..... *F04D 25/024* (2013.01); *F04D 13/021* (2013.01); *F04D 29/0405* (2013.01);
(Continued)

(58) Field of Classification Search
CPC .. F04D 29/054; F04D 29/0405; F04D 13/021; F04D 29/5806; F04D 25/024;
(Continued)

(56) References Cited

U.S. PATENT DOCUMENTS 2,226,986 A 12/1940 Wechsberg et al.
2,694,157 A 11/1954 Cone
(Continued)

OTHER PUBLICATIONS

Giri L. Agrawal, "Foil Air/Gas Bearing Technology—An Overview," Presented at the International Gas Turbine & Aeroengine Congress & Exhibition, Jun. 2-Jun. 5, 1997, pp. 1-11, 97-GT-347.

*Primary Examiner* — Bryan Lettman

(74) *Attorney, Agent, or Firm* — McCormick, Paulding & Huber LLP

(57) ABSTRACT

A hermetically-sealed turbomachine, such as a motor-driven blower and a turbine driven generator, capable of reliable high-temperature operation, especially for large sized turbomachine includes a hot blower, compressor or turbine end of the turbomachine that is separated from the cooler electric motor, generator or alternator end of the turbomachine by a compliant mechanical coupling and a thermal choke assembly. The turbomachine housing is also hermetically sealed, providing control over the process gas within the machine housing, and permitting an internal cooling method within the turbomachine, whereby a small amount of process gas itself is used within the turbomachine for providing cooling of the rotating shafts, the axial fan, radial fan, or turbine impeller, the bearings and the electric motor, generator or alternator disposed within the turbomachine housing. The cooling method can be aided by a heat exchanger operatively communicating with the turbomachine.

25 Claims, 5 Drawing Sheets

(51) Int. Cl.
*F04D 13/02* (2006.01)
*F04D 29/054* (2006.01)
*F04D 29/58* (2006.01)
*F04D 25/06* (2006.01)

(52) U.S. Cl.
CPC ..... *F04D 29/054* (2013.01); *F04D 29/5806* (2013.01); *F04D 25/0606* (2013.01)

(58) Field of Classification Search
CPC ..... F04D 25/0606; H02K 1/325; F01D 25/12; F01D 25/14; F01D 15/10; F01D 15/105; F01D 25/168
USPC ..... 417/423.6, 423.8, 423.12, 373, 411
See application file for complete search history.

(56) References Cited

U.S. PATENT DOCUMENTS 2,735,027 A 2/1956 Formhals et al.
2,972,309 A 2/1961 Bollibon et al.
2,994,004 A 7/1961 Macha et al.
3,022,739 A 2/1962 Herrick et al.
3,094,272 A 6/1963 McClure
3,105,631 A 10/1963 Hanny
3,296,824 A 1/1967 Rohrs et al.
3,375,046 A 3/1968 Marley
3,382,014 A 5/1968 Marley
3,391,291 A 7/1968 Benson et al.
3,394,659 A 7/1968 Van Alen
3,635,534 A 1/1972 Barnett
3,981,628 A 9/1976 Carter
4,120,616 A 10/1978 Dwyer et al.
4,167,295 A 9/1979 Glaser
4,171,928 A 10/1979 Emerson
4,209,207 A 6/1980 Schippers et al.
4,247,155 A 1/1981 Fortmann
4,262,975 A 4/1981 Heshmat et al.
4,274,683 A 6/1981 Gray et al.
4,277,111 A 7/1981 Gray et al.
4,277,112 A 7/1981 Heshmat
4,277,113 A 7/1981 Heshmat
4,295,689 A 10/1981 Licht
4,296,976 A 10/1981 Heshmat
4,300,806 A 11/1981 Heshmat
4,301,375 A 11/1981 Anderson
4,362,020 A 12/1982 Meacher et al.
4,402,618 A 9/1983 Fortmann et al.
4,408,953 A * 10/1983 Nasvytis et al. ..... 415/62
4,415,280 A 11/1983 Agrawal
4,415,281 A 11/1983 Agrawal
4,523,896 A 6/1985 Lhenry et al.
4,552,466 A 11/1985 Warren
4,557,664 A 12/1985 Tuttle et al.
4,558,228 A 12/1985 Larjola
4,614,482 A 9/1986 Gaffal
4,668,106 A 5/1987 Gu
4,699,523 A 10/1987 Hagemeister
4,713,739 A 12/1987 Ryder et al.
4,865,517 A 9/1989 Beehler
5,045,711 A 9/1991 Swearingen
5,083,040 A 1/1992 Whitford et al.
5,110,220 A 5/1992 Gu
5,248,205 A 9/1993 Gu et al.
5,310,311 A 5/1994 Andres et al.
5,318,366 A 6/1994 Nadjafi
5,375,651 A 12/1994 Colwell
5,497,615 A * 3/1996 Noe et al. ..... 60/39.511
5,498,083 A 3/1996 Brown
5,547,286 A 8/1996 Struziak
5,584,582 A 12/1996 Brown
5,634,723 A 6/1997 Agrawal
5,642,008 A 6/1997 McCracken
5,789,824 A 8/1998 Selfors et al.
5,794,300 A 8/1998 McCracken et al.
5,831,341 A 11/1998 Selfors et al.
5,833,369 A 11/1998 Heshmat
5,845,509 A 12/1998 Shaw et al.
5,857,348 A 1/1999 Conry
5,893,423 A 4/1999 Selfors et al.
5,961,217 A 10/1999 Heshmat
5,988,885 A 11/1999 Heshmat
6,046,509 A 4/2000 LaBaire
6,050,727 A 4/2000 Messmer et al.
6,102,672 A 8/2000 Woollenweber et al.
6,155,802 A 12/2000 Choi et al.
6,158,893 A 12/2000 Heshmat
6,193,473 B1 * 2/2001 Mruk et al. ..... 417/350
6,302,661 B1 10/2001 Khanwilkar et al.
6,307,278 B1 10/2001 Nims et al.
6,353,273 B1 3/2002 Heshmat et al.
6,375,438 B1 4/2002 Seo
6,450,781 B1 9/2002 Petrovich et al.
6,471,493 B2 10/2002 Choi et al.
6,488,467 B2 12/2002 Czechowski et al.
6,498,410 B1 12/2002 Yashiro et al.
6,499,955 B2 12/2002 Choi et al.
6,505,837 B1 1/2003 Heshmat
6,523,366 B1 2/2003 Bonaquist et al.
6,579,078 B2 6/2003 Hill et al.
6,608,418 B2 8/2003 Andres et al.
6,634,853 B1 10/2003 Anderson
RE38,373 E 12/2003 Bosley
6,698,929 B2 3/2004 Choi et al.
6,702,463 B1 3/2004 Brockett et al.
6,752,533 B2 6/2004 Saville et al.
6,770,993 B1 8/2004 Heshmat et al.
6,830,842 B2 12/2004 Siepierski et al.
6,881,027 B2 4/2005 Klaass et al.
6,948,853 B2 9/2005 Agrawal
6,951,241 B1 10/2005 Gatley
6,965,181 B1 11/2005 Heshmat et al.
6,997,686 B2 2/2006 Agrawal et al.
7,021,905 B2 4/2006 Torrey et al.
7,063,519 B2 6/2006 Agrawal et al.
7,070,330 B2 7/2006 Agrawal
7,112,036 B2 * 9/2006 Lubell et al. ..... 415/104
7,261,300 B2 8/2007 Agrawal et al.
7,574,867 B2 8/2009 Teets et al.
7,591,632 B2 9/2009 Baecke et al.
7,614,853 B2 11/2009 Saville
7,624,592 B2 12/2009 Lui et al.
7,728,475 B2 6/2010 Himmelmann
7,784,279 B2 8/2010 Shindo
7,948,105 B2 5/2011 Agrawal et al.
8,029,194 B2 10/2011 Agrawal et al.
8,215,928 B2 7/2012 Agrawal et al.
2003/0038553 A1 2/2003 Andres et al.
2003/0111842 A1 * 6/2003 Gilbreth ..... F01D 15/10 290/52
2004/0066991 A1 4/2004 Agrawal
2004/0161333 A1 8/2004 Klaass et al.
2004/0189126 A1 9/2004 Brunet et al.
2005/0126182 A1 6/2005 Teets et al.
2007/0108772 A1 * 5/2007 Shibui ..... F01D 15/10 290/52
2007/0266695 A1 11/2007 Lui et al.
2008/0197634 A1 8/2008 Himmelmann
2008/0232962 A1 9/2008 Agrawal et al.
2008/0236261 A1 * 10/2008 Ono ..... F01D 25/285 73/112.01
2009/0028730 A1 1/2009 Radermacher et al.
2009/0241542 A1 * 10/2009 Ono ..... F01D 25/16 60/624
2010/0119354 A1 * 5/2010 Bosen ..... F01D 5/02 415/14
2010/0201127 A1 8/2010 Himmelmann

* cited by examiner

MECHANICALLY-COUPLED TURBOMACHINERY CONFIGURATIONS AND COOLING METHODS FOR HERMETICALLY-SEALED HIGH-TEMPERATURE OPERATION

CROSS-REFERENCE TO RELATED APPLICATION

This application claims the benefit of U.S. Provisional Application No. 61/368,037, filed Jul. 27, 2010, which is incorporated herein by reference.

FIELD OF THE INVENTION

The present invention generally relates to the conception, design and manufacture of turbomachinery, such as blowers, compressors, generators, and alternators, and associated technologies integrating such devices, with particular emphasis on turbomachines capable of operating at high temperatures. More particularly, the present invention relates motor-driven blowers and compressors, and turbine-driven generators and alternators, varying in size from a few kilowatts to a few thousand kilowatts, and capable of operating at high temperatures for use in a variety of applications. The present invention also generally relates to methods for cooling such turbomachinery.

BACKGROUND OF THE INVENTION

Historically, positive displacement machines and turbomachines, such as blowers and compressors, have been used to generate compressed or pressurized gas. Turbomachines are high technology machines that typically involve high engineering, production and assembly costs in order to achieve and maintain desired levels of performance and efficiency with reduced repair and safety concerns. Such high costs are typically due to complex design issues, lengthy assembly procedures, and detailed maintenance requirements, all greatly influenced by the operational requirements for the machinery. For example, fuel cell systems used in diverse stationary, mobile, military and commercial applications use blowers and compressors to pressurize high-temperature process gas. However, such systems typically require the machinery to fit into a tight footprint so as to not take up too much space, without compromising operation and efficiency of the overall system. Additionally, suitable blowers and compressors have long been desired to achieve high reliability and maintain high efficiency at high operating temperatures. Because of the high temperatures exerted on and by any systems using such machines, adequate insulation, cooling, design and safety precautions are required. Additionally, it is desirable to minimize waste, and thus, efforts have been made to minimize and eliminate leakage of process gas from the system, and more preferably, reuse the process gas for operation and cooling of the turbomachine. However, these concerns must be addressed without affecting the desired operation of the blowers and compressors used in such turbomachinery.

Hermetically-sealed high-temperature turbomachines are needed for several applications, such as fuel cell systems, nuclear plants, chemical processing plants, waste heat recovery systems, and the like. Adequate turbomachines are presently not available for handling handle high-temperature process gases without significant drawbacks. For example, for applications such as waste heat recovery systems, the process cycle fluid needs to be recirculated through the internal system components at high temperatures without effecting operation of the system, damaging system components, or leaking any processing fluid. Accordingly, high-temperature (e.g., ≥850° C.) operation of turbomachines must be reliable. Turbomachinery that is hermetically sealed so that the high-temperature process gas is adequately contained is also a prime concern.

Existing state-of-the-art technologies are not completely gas-tight or leak proof. Undesired leakage of process gas both within and from the turbomachine can effect operation of the system. In high-temperature operations, leakage of process gas can also be unsafe. Such state-of-the-art technologies are also often limited in temperature capability due to bearing and electric component failure. Major causes of failure are poor suppression of heat transfer from hot process gas to the turbomachine components, deficient cooling schemes, and, again, undesirable leakage within and from the machine housing.

FIG. 1 illustrates a conventional turbomachine configuration 10, such as for a blower or a compressor, designed to handle high-temperature process gas. The conventional turbomachine design for such operations generally comprises a rotor device 12 for handling the hot process gas disposed within a "hot end" machine housing, illustrated as reference numeral 14 in FIG. 1. A motor 16 and roller bearings 18 are commonly placed outside the "hot end" of the machine 10. A mechanical seal 20 is installed near the "hot end" housing 14 to hermetically seal the machine housing 14 and thus reduce leakage therefrom.

A representative prior art hermetically-sealed small blower concept is described in more detail in U.S. Pat. No. 6,830,842 B2, where hydrogen gas is fed at a higher pressure from an aft end of the blower to cool the motor and bearings therein. The described concept in this patent is insufficient for applications where a cooler purge gas that is also compatible with the process gas is not readily available. Also, in this representative design concept, the blower fore end processing the hot process gas is directly connected to the motor end by a common rotating shaft, which exposes the blower to high heat flux via the common rotating shaft. The high heat flux generated by the common rotating shaft compromises the temperature capability of the blower. The described concept is therefore feasible only for small-sized blowers and cannot easily be scaled up for larger sized turbomachines of about a few hundred kilowatts, where the amount of heat flux conducted through the common rotating shaft could cause failure of the internal electric components and bearings.

Another hermetically-sealed small blower concept that is representative of the prior art is described in copending U.S. Application Publication No. 2009/0087299 A1, assigned to the owner of the present invention and incorporated herein by reference, where a self-sustaining cooling process is achieved by recirculation of entrapped process gas in the motor housing of the blower. Such a self-sustaining cooling process relies on natural convection of fins formed on the blower housing for sufficient cooling of relevant machine components. The described concept is feasible for small-sized blowers only, as it relies on natural convection. Natural convection is a poor mode for heat removal, especially for larger-sized blowers. Also, in such a design, the rotating shaft extends from the "hot end" of the machine to the motor side as a single, integral component, which conducts high heat flux in the blower. Accordingly, the applicability of the blower concept is again limited to only small-sized blowers—e.g., less than 1 kilowatt—because of the high heat flux generated by the common rotating shaft.

The conventional turbomachine configuration illustrated in FIG. 1 has numerous disadvantages. For example, such conventional turbomachine configurations are often not truly hermetically-sealed and, as a result, the leakage rate of hot process gas from the "hot end" of the machine housing greatly depends on the type of mechanical seal used. Mechanical-type seals, as are commonly used in conventional configurations such as illustrated in FIG. 1, leak process gas continuously. Wear of such seals due to rotation of a common rotating shaft will eventually increase the leakage rate and expedite failure of the seal. In alternate configurations of conventional turbomachines of the type illustrated in FIG. 1, a purge gas, such as nitrogen or air, may be used to keep the mechanical seals from leaking the hot process gas. In such designs, however, the purge gas is usually undesirable as it may contaminate the process gas. Purge gases also require an extraneous feed system to continuously provide purging for the system. Purge gas sealing may still leak hot process gas depending on the process gas pressure and the capability of the extraneous purge feed system to respond to system pressures.

Additionally, roller element bearings lubricated by oil or grease, as are commonly used in conventional configurations, such as illustrated in FIG. 1, contaminate the process gas and cannot withstand high operational temperatures, as the lubrication will coke and cause failure of the bearings. As a result, conventional turbomachine configurations often need mechanical seals to place the bearings far enough from the hot gas rotor to reduce and preferably avoid coking of the lubricant. Often, the threat of coking and the likely resultant bearing failure also limit the operational temperature capability of the machine.

Still additionally, commercial electric motors, generators and alternators used in conventional turbomachine configurations of the type illustrated in FIG. 1 are usually rated at maximum ambient temperature of about 180° C. Operation of the turbomachine above this temperature will cause insulation break down and failure of the machine.

Attempts are constantly being made to achieve complete hermeticity and reliable operation for turbomachine configurations at high temperatures (e.g., ≥850° C.). To this end, there is a need for a turbomachine configuration, adaptable to both motor-driven blower and compressor designs, and turbine-driven generator and alternator designs, whereby the machine housing is hermetically sealed, the internal components are adaptable to operating at extremely high temperatures without affected operation and premature failure, and whereby the machine includes a self-contained cooling process utilizing the process gas already in the machine.

In view of the foregoing, there is a need for a turbomachine design that can operate efficiently at high temperatures with a hermetically sealed housing design, without suffering from the drawbacks common to prior art blower, compressor, generator, and alternator designs that tend to affect performance, operation and efficiency, require frequent repair, and moreover, tend to compromise product safety. Accordingly, it is a general object of the present invention to provide a high-temperature turbomachine, be it a motor-driven blower or compressor, or a turbine-driven generator or alternator, that overcomes the problems and drawbacks associated with the use of such machines at high temperatures on the order of 850° C. or greater.

SUMMARY OF THE INVENTION

The present invention is generally directed to a hermetically-sealed, high-temperature turbomachine design, especially adapted to motor-driven designs, comprising a blower or a compressor, and turbine-driven designs, comprising a generator or an alternator. The proposed high-temperature turbomachine configuration of the present invention avoids the problems and drawbacks common to prior art turbomachine designs, for example, such as those discussed above, by using a unique internal cooling process that is self-sustaining. The present invention also uses bearing technology that permits a sealed, contamination free, high-speed, efficient, self-cooling design, with improved efficiency and reduced noise levels.

In one aspect of the present invention, a high-temperature, bearing-supported turbomachine is provided. The machine comprises a "hot end" including a blower, a compressor or a turbine with a process gas inlet and a process gas outlet. The machine also comprises a "cool end" including a motor, a generator, or an alternator provided in a hermetically sealed housing. The present invention further includes a mechanically coupled design that is provided as means to separate the "hot end" of the machine from the "cool end" of the machine while maintaining adequate torque between respective rotating assemblies on each side. A small percentage of process gas itself is used inside the turbomachine, preferably in conjunction with an operatively connected heat exchanger, for providing cooling for rotating shafts, blower, compressor or turbine rotors, bearings, and the electric motor, generator or alternator, without affecting complete hermeticity of the machine.

In an embodiment of the present invention, a turbomachine for processing a high-temperature gas comprises a hot end and a cool end. The hot end processes the gas flowing between an inlet and an outlet, and includes a hot end rotating shaft mounted for rotation about a central longitudinal axis, a rotor device mounted of the hot end rotating shaft for rotation therewith, at least one hot end journal bearing assembly radially supporting the hot end rotating shaft and a hot end thrust bearing assembly axially supporting the hot end rotating shaft. The cool end has an electric component housing and includes a cool end rotating shaft mounted within the electric component housing for rotation about a central longitudinal axis, an electric component comprising a rotor mounted for rotation with the cool end rotating shaft and a stator assembly mounted in stationary relationship with the electric component housing relative to the rotor, at least one cool end journal bearing assembly radially supporting the cool end rotating shaft, and a cool end thrust bearing assembly axially supporting the cool end rotating shaft. A compliant mechanical coupling is connected between the hot end rotating shaft and the cool end rotating shaft to transfer operational torque between the respective rotating shafts and to suppress heat transfer from the hot end to the cool end.

In another embodiment of the present invention, a hermetically-sealed turbomachine having a drive end and a driven end for handling a high-temperature process gas comprises a hot end taking the form of one of a blower, a compressor and a turbine, and an electric component end taking the form of one of a motor, a generator and an alternator maintained at a relatively lower temperature than the hot end. The hot end includes a hot end rotating assembly mounted within the hot end to handle the process gas between an inlet and an outlet of the hot end. The electric component end includes an electric component end rotating assembly that drives or is driven by the hot end rotating assembly. A compliant mechanical coupling connects the hot end rotating assembly with the electric component end rotating assembly. A thermal choke assembly is disposed between the hot end and the electric component end. The mechanical coupling and the thermal choke assembly collectively suppress heat transfer from the hot end to the relatively lower temperature electric component end.

The present invention is also directed to a recirculation cooling method for cooling the turbomachine and its internal components. In one aspect of the cooling method of the present invention, a small amount of process gas is used within the turbomachine for cooling the "hot end" rotating shaft, the turbine-, blower- or compressor-side fan or impeller, the "hot end" bearings, the "cool end" rotating shaft, the electric motor, generator or alternator, and the "cool end" bearings.

In an embodiment of the cooling method in accordance with the present invention, the method comprises providing a cooling circuit path for guiding a process gas contained within a turbomachine over the rotating assemblies of a hot end and a cool end of the turbomachine. The process gas is drawn through the cooling circuit path using a cooling fan mounted on the cool end rotating assembly for rotation therewith. Additionally, heat transfer from the hot end to the cool end of the turbomachine is suppressed. The heat transfer may be suppressed by a thermal choke assembly disposed between the hot end and the cool end of the turbomachine, and/or by a compliant mechanical coupling connecting the hot end rotating assembly with the cool end rotating assembly.

In another aspect of the cooling method of the present invention, the cooling flow can be aided by a heat exchanger operatively communicating with the turbomachine via cooling piping.

In accordance with the present invention, the "hot end" of the machine, which handles the hot process gas, is separated from the cool end, which houses the main electric component of the machine—such as, an electric motor for a motor-driven design, a generator for a turbine-driven design, or an alternator for a turbine-driven design. A compliant mechanical coupling that transmits torque from the drive end to the driven end with minimum heat conduction preferably separates the two ends. As a result, the total rotating assembly comprises two separate sets of similar rotating components, such as a rotating shaft, journal bearings and thrust bearings. One set is associated with the "hot end" rotor; and the other set is associated with the main electric component on the "cool end". The mechanical coupling is provided in between the respective rotating assembly sets for torque transmission therebetween.

The turbomachine of the present invention may utilize an innovative thermal choke assembly to define a thermal barrier separating the "hot end" from the "cool end." The thermal choke assembly, as positioned between the "hot end" and the "cool end," reduces heat transfer from the "hot end" to the "cool end." The thermal choke assembly preferably utilizes choke plates having a thin cross-section that permits the choke assembly to act as a heat block between the "hot end" and the "cool" electric component end. The thermal choke assembly also facilitates alignment of the electric component end housing and components in relation to the "hot end" housing.

In accordance with another aspect of the present invention, the "cool" electric component end of the turbomachine includes a cooling fan that forces a small amount of process gas trapped in the machine housing through the machine to absorb heat from internal machine components, such as the bearings, rotating shafts, the "hot end" rotor component (e.g., an impeller or a fan), and the main electric component (e.g., a motor, a generator or an alternator) used therein. In a preferred embodiment, the absorbed heat is dumped outside of the machine through a heat exchanger operatively communicating with the machine.

In accordance with another aspect of the present invention, a cooling jacket using fluid, such as water, air or the like, to cool the main electric component of the machine (e.g., a motor, a generator or an alternator) may also be used to convect stator heat from the machine.

In the case of motor-driven blower or compressor applications in accordance with the present invention, the "hot end" of the machine raises the pressure of the process gas by an axial or a radial rotor device, such as a fan. In operation, electrical energy is supplied to the motor on the "cool" electric component end to drive the "hot end" rotating shaft. Rotation of the "hot end" rotating shaft effects rotation of the fan, which, in turn, pressurizes process gas flowing between an inlet and an outlet of the "hot end." The motor is preferably controlled by an inverter and/or a controller.

In the case of turbine-driven generator or alternator applications in accordance with the present invention, the "hot end" of the machine includes a turbine that expands the process gas by an axial or a radial rotor, such as an impeller. In operation, the "hot end" process gas expands in the turbine and drives the generator located on the "cool" electric component end to produce electrical energy. The generator or alternator is connected to a power grid through power electronics, such that electrical energy produced by the generator or alternator is provided to the grid.

In preferred embodiments of the present invention, pairs of foil-type hydrodynamic gas journal and thrust bearings support the "hot end" rotating shaft, and pairs of foil-type hydrodynamic gas journal and thrust bearings support the "cool end" rotating shaft. Alternatively, the present invention can be used for turbomachines supported on ceramic-type ball bearings or pressurized hydrostatic bearing without compromising design or operation of the turbomachine.

In accordance with still another aspect of the present invention, a protective sleeve may be provided as a ducting over the rotating assembly in the "hot end" of the machine such that the hot process gas can flow over the internal components, such as the bearings, without coming in direct contact with such components.

The entire machine assembly in accordance with the present invention may be mounted on a stand where cooling flow piping and a heat exchanger are provided in operative communication with the machine assembly and attached as necessary.

Various fields of application for the present invention in motor-driven blower or compressor configurations include fuel cell systems; heat treatment furnaces; pollution control; chemical plants; food processing; for turbocharging of automobiles; and in the petroleum, nuclear, and pulp and paper industries.

Various fields of application for the present invention in turbine-driven generator or alternator configurations include waste heat recovery systems; organic Rankine cycle systems; and steam power generation plants.

A particular advantage of the present invention is that the turbomachine design enables highly reliable operation of hermetically-sealed and contamination-free turbomachines at high temperatures (e.g., ≥850° C.). Chemical processing plants, nuclear plants, the petroleum industry, and the like, will advantageously benefit from enabling higher temperature operation of turbomachines that are also hermetically sealed. The present invention also improves overall efficiency of systems in which it is used, such as large fuel cell plants, Rankine cycle systems, waste heat recovery systems, and the like, by enabling high-temperature operation without compromising operation of efficiency.

Another advantage of the present invention is that the turbomachine utilizes a coupled configuration along with a thermal choke assembly that collectively minimize the exposure of heat conductions to the internal electric components, thereby protecting the components from premature failure.

Another advantage of the present invention is that a cooling fan provided in the "cool" electric component end of the machine recirculates a percentage of process gas within the turbomachine to cool internal machine components, thereby permitting the machine to be hermetically-sealed, gas tight, and leak proof. A heat exchanger may further be provided in operative communication with the machine to improve internal cooling of the components using only process gas cycled through the machine and the heat exchanger and without compromising the hermetically-sealed design of the machine housing. The improved cooling process also allows the machine to operate at higher temperatures.

Another advantage of the present invention is that during operation of the turbomachine, the "hot end" rotating shaft may be cooled by forcing cooling gas through a protective sleeve disposed within the machine housing around the rotating assembly, thereby keeping the temperature of the bearings, the rotating shaft and the "hot end" rotor device below limit, thereby increasing the operative life of such components.

These and other features of the present invention are described with reference to the drawings of preferred embodiments of a bearing-supported, high-temperature, hermetically-sealed turbomachine configuration. The illustrated embodiments of the turbomachine configuration in accordance with the present invention are intended to illustrate, but not limit, the invention.

DETAILED DESCRIPTION OF THE INVENTION AND PREFERRED EMBODIMENTS THEREOF

Figure 1:
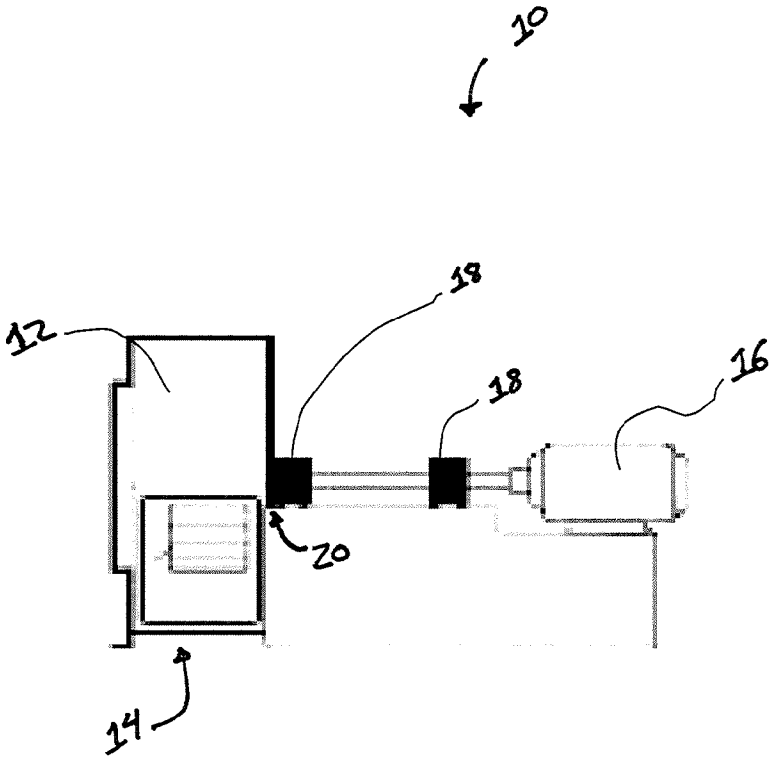
PRIOR ART FIG. 1
FIG. 1 illustrates a schematic of a prior art blower configuration currently being used in the market.
Figure 2:
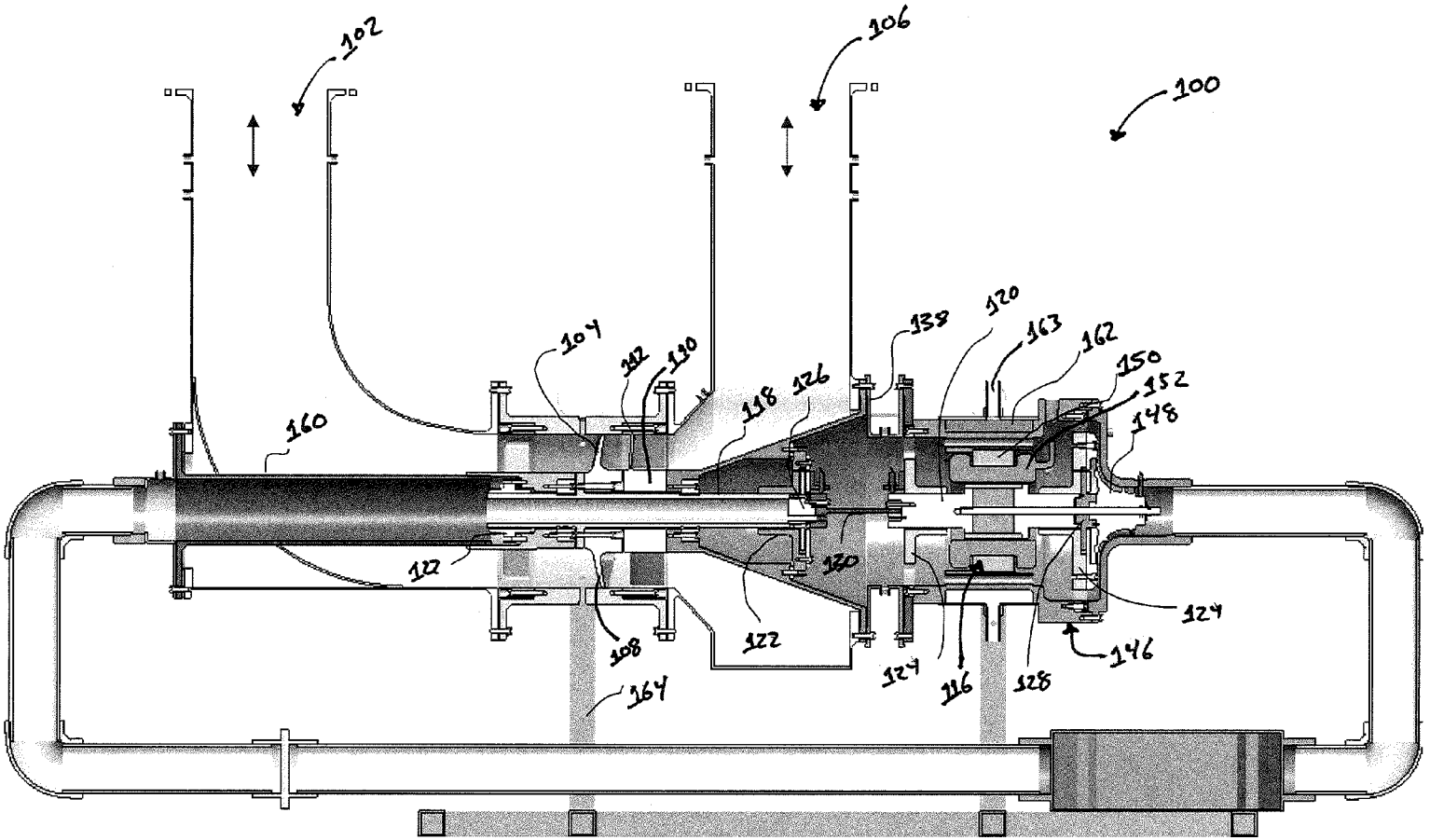
FIG. 2 shows a cross-sectional view of an axial-type turbomachine embodying the present invention.
Figure 3:
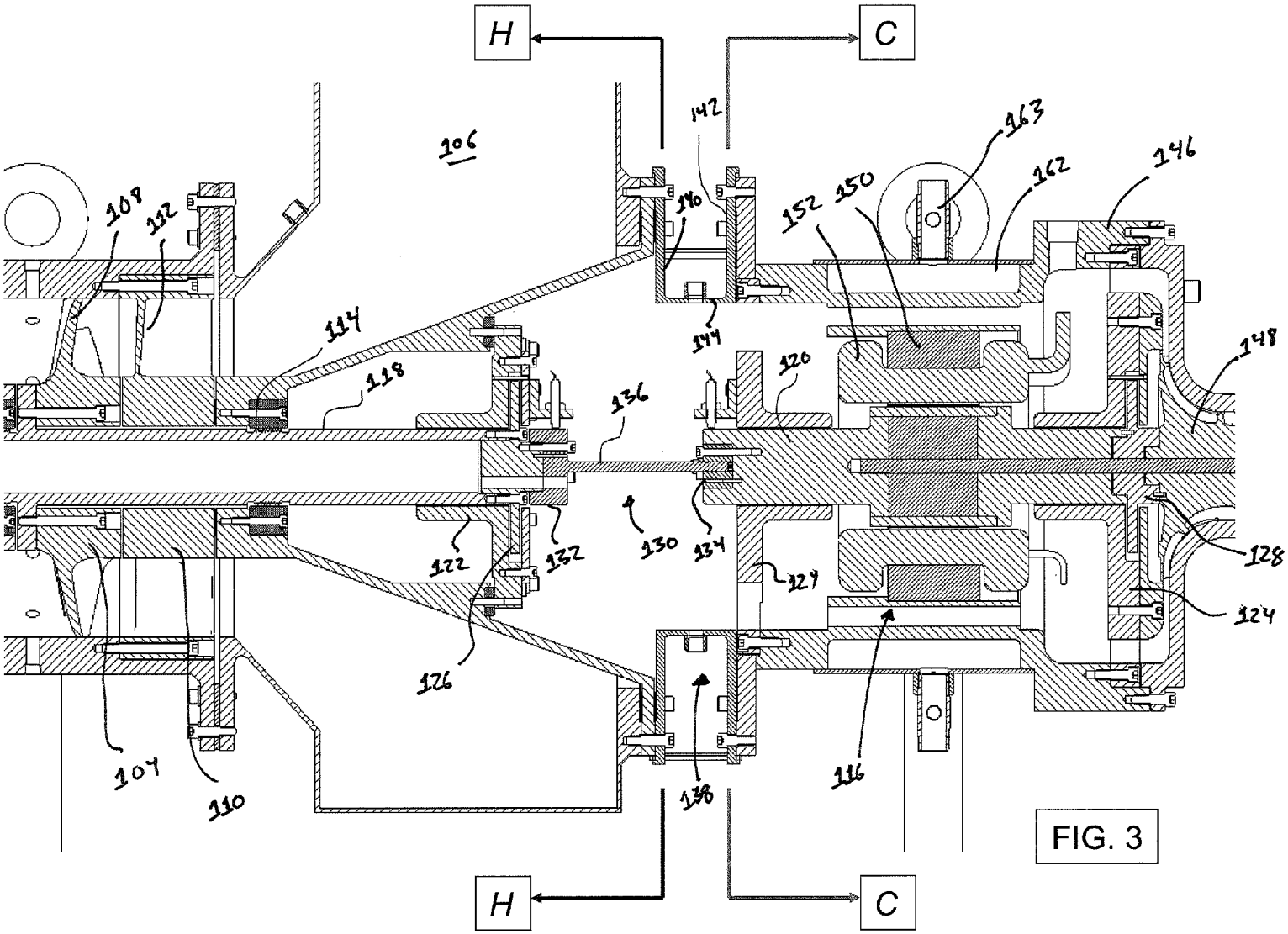
FIG. 3 shows a close up cross-sectional view of the turbomachine of FIG. 2 illustrating a "hot end" and a "cool end" in accordance with the present invention.

A turbomachine configuration in accordance with the present invention is generally illustrated in FIGS. 2 and 3. As shown and described hereinafter, the illustrated turbomachine may be a motor-driven blower. However, the turbomachine is equally adaptable as a motor-driven compressor without affecting the advantages or operation of the machine. Likewise, the present invention can be utilized in regards to a turbine-driven generator or a turbine-driven alternator, without departing from the spirit and principles of the present invention.

A cross-sectional view of an axial-type turbomachine, generally designated by reference numeral 100, is provided in FIG. 2. More particularly, FIG. 3 illustrates separate "hot" and "cool" sides of the turbomachine 100 and a thermal barrier formed therebetween to reduce and preferably prevent heat transfer from the "hot end" H to the "cool end" C, as described in more detail below. In general, the turbomachine 100 of the present invention is intended to operate in high-temperature conditions, for example, handling a process gas at about 850° C. and greater.

As illustrated in FIG. 3, the turbomachine 100 of the present invention is divided into the hot end H and the cool end C. In short, the hot end H is so designated because of the high temperatures of the process gas passing through that portion of the turbomachine 100—be it a blower, a compressor, or a turbine. By comparison, the cool end C is so designated because of the aim to keep the components on that side of the turbomachine 100 at lower temperatures during operation. The cool end C may also be referred to as the "electric component side" of the turbomachine, generally comprising a motor for driving a blower or compressor, or in alternate designs of the present invention, generally comprising a generator or an alternator that is driven by a turbine disposed in the hot end H of the machine.

Each end of the turbomachine 100 comprises a separate rotating assembly. Each of the hot end rotating assembly and the cool end rotating assembly comprises the same or similar rotating components, such as a rotating shaft, journal bearings and thrust bearings, the structural arrangement and functional operation of which are described in more detail below.

Due to the intended operation of the turbomachine 100 at high temperatures—i.e., on the order of at least about 850° C.—the components on the cool end C must be cooled during operation to maintain desirable levels of performance and efficiency. Accordingly, the present invention has been designed to reduce and ideally prevent, or control, heat transfer due to the hot process gas from the hot end H to the cool end C. More particularly, the present invention is aimed at blocking all the modes of heat transfer from the hot end H to the cool end C—namely, convection, conduction and radiation. As discussed in more detail below, this is accomplished, in part, by an innovative thermal choke assembly disposed between the hot end H and the cool end C.

In regards to FIG. 2, the turbomachine 100 of the present invention shall be generally described hereinafter with reference to a motor-driven blower, unless otherwise noted. As shown, the turbomachine 100 includes inlet ducting 102 that guides the flow of a process gas to the hot end H of the machine. In particular, the process gas is drawn into the inlet ducting 102 by a rotor device 104, which is driven by a motor 116 on the cool end C of the machine. The rotor device 104 processes the process gas, for example, by increasing the pressure of the process gas passing therethrough in an axial-type motor-driven blower design, as shown. The pressurized process gas is thereafter exhausted through outlet ducting 106. In FIG. 2, the rotor device 104 is illustrated as an axial fan that raises the pressure of the process gas passing through rotating vanes, generally illustrated as reference numeral 108. A stator or diffuser 110 with stationary vanes 112 disposed downstream from the axial fan 104 further raises the pressure of the process gas by diffusion, and directs the gas to the outlet ducting 106, which may further include a volute in accordance with traditional blower designs.

In an axial-type turbine-driven alternator or generator set-up of the turbomachine 100 shown in FIG. 2, the general structure of the turbomachine 100 remains the same. However, the flow direction of the process gas is reversed. Thus, where the hot end H comprises a turbine, the ducting 106 acts as an inlet for a high-temperature pressurized gas. The process gas passes through the stator 110 with stationary vanes 112 and the rotor device 104, which in the turbine-driven set-up of the present invention comprises a turbine impeller having rotating blades 108. The impeller 104 processes the process gas—e.g., by expanding the gas as it passes through the impeller blades 108—and exhausts the process gas through the ducting 102, acting as an outlet for the process gas.

In preferred applications for the turbomachine 100 of the present invention, the process gas is preferably a high-temperature gas, typically on the order of about 850° C. or greater. As shown in FIG. 3, a labyrinth seal 114 disposed within the hot end H keeps the hot process gas from leaking excessively into the inner core of the machine 100 where a rotating assembly for the cool end C is located. However, some leakage of a small amount of process gas is permitted, as controlled by the labyrinth seal 114, for cooling the internal components of the turbomachine 100, as discussed in more detail below.

In the motor-driven blower design of the present invention, the motor 116 mounted in the cool end C of the machine drives the axial fan 104 mounted for rotation in the hot end H of the machine to process the process gas. In the turbine-driven blower design of the present invention, the turbine impeller 104 mounted for rotation in the hot end H of the machine drives a generator or an alternator device 116 mounted in the cool end C of the machine to convert mechanical work into electrical energy. In both designs, the rotor device 104 (e.g., axial fan or turbine impeller) in the hot end H is mounted for rotation on a hot end rotating shaft 118, while the electric component 116 in the cool end C is operatively associated with a cool end rotating shaft 120. Each of the rotating shafts 118 and 120 is radially supported within its respective end of the machine 100 by a respective pair of hydrodynamic journal bearings 122 and 124, and axially supported by a respective pair of hydrostatic or hydrodynamic thrust bearings 126 and 128.

In accordance with the present invention, the hot end rotating shaft 118 is separated from the cool end rotating shaft 120 by a compliant mechanical coupling 130, as shown in FIG. 3. The mechanical coupling 130 connects the hot end rotating shaft 118 with the cool end rotating shaft 120 such that the rotation of the cool end rotating shaft 120 effects rotation of the hot end rotating shaft 118 in a motor-driven turbomachine design, and rotation of the hot end rotating shaft 118 effects rotation of the cool end rotating shaft 120 in a turbine-driven turbomachine design. In operation, a process gas enters the hot end H through inlet ducting 102 or 106. The process gas is passed through the rotor device 104 for processing. As previously noted, the pressure of the process gas is increased or expanded as it passes through the components of the hot end H, and the high-pressure process gas is exhausted from the machine 100 through outlet ducting 106 or 102.

In a motor-driven design of the present invention, operation of the motor 116 is effected by a controller or an inverter (not shown), which causes rotation of the cool end rotating shaft 120, which, via the mechanical coupling 130, drives the hot end rotating shaft 118. Rotation of the hot end rotating shaft 118 about its axis of rotation (which is often the same as the axis of rotation for the cool end rotating shaft 120) causes the axial fan 104 to rotate and draw the process gas in and through the hot end H of the machine 100 between the inlet ducting 102 and the outlet ducting 106 while, as noted, the pressure of the process gas is increased.

In a turbine-driven design of the present invention, process gas passing through the hot end H between the inlet ducting 106 and the outlet ducting 102 causes the turbine impeller 104 to rotate about its axis of rotation. Upon rotation of the turbine impeller 104, the hot end rotating shaft 118 also rotates, and, via the mechanical coupling 130, drives the cool end rotating shaft 120 about its axis of rotation (which is often the same as the axis of rotation for the hot end rotating shaft 118). Rotation of the cool end rotating shaft 120 generates electrical energy as a result of the relational rotation between the rotor and stator of the cool end generator or alternator 116. Thus, the turbomachine 100 converts mechanical energy to shaft work, which, in the generator or alternator 116, is converted to electrical power. This electrical power can be withdrawn from the machine 100 through a power converter (not shown) and provided to any designated external machine, power storage unit, or the like.

As shown in FIG. 3, the compliant mechanical coupling 130 comprises a first end 132 secured to the hot end rotating shaft 118 and a second end 134 secured to the cool end rotating shaft 120. An intermediate section 136 is disposed between the first and second ends 132 and 134. The mechanical coupling 130 is preferably designed as a splined-type with compliancy so that it can accommodate any misalignment between the hot end and cool end rotating assemblies. As so designed, the first and second ends 132 and 134 of the coupling 130 include ridges, teeth, or grooves that mesh with complementary shaped grooves, teeth, or ridges in the respective ends of the hot end and cool end rotating shafts 118 and 120. As shown in more detail in FIG. 3, the first end 132 of the coupling 130 is generally designed to fit around the end of the hot end rotating shaft 118, while the second end 134 of the coupling 130 is generally designed to fit within a recess formed in the end of the cool end rotating shaft 120. These forms of connection are merely illustrations of how the rotation parts can be coupled together to transfer torque while maintaining the appropriate angular correspondence between them. Any known means of connecting such rotating parts may be used without departing from the principles and spirit of the present invention. The first and second ends 132 and 134 are further secured into place by common fasteners, such as bolts, which ensure that the coupling 130 rotates with the drive shaft and transfers torque to the driven shaft, while maintaining the appropriate angular correspondence between all the rotating parts.

Preferably, the operational axes of rotation for the hot end rotating shaft 118 and the cool end rotating shaft 120 are common. In accordance with the present invention, the mechanical coupling 130 is compliant, and acts to accommodate any deviation between the rotational axes so that the torque between the drive shaft and the drive shaft is transferred in an efficient manner. The mechanical coupling 130 preferably also permits axial movement of the respective rotating shafts 118 and 120 to let the hot end and the cool end rotating assemblies move independently to react to and accommodate thermal and dynamic loads exerted during operation. As a result, the mechanical coupling 130, under all operating conditions, allows uniform torque transformation.

Heat transfer from the hot process gas is suppressed, in part, from flowing through to the cool end C of the machine 100, and thus to the motor 116, by the mechanical coupling 130. Typical commercial motors are rated for maximum operation at 180° C. The present invention suppresses heat transfer from the hot end rotating assembly to the cool end C by reducing the cross-section of the heat path through the coupling 130—for example, by reducing the cross-sectional area of the intermediate section 136 of the coupling 130. Heat transfer through the machine housing is further reduced through a thermal choke assembly 138, which preferably utilizes choke plates having a thin cross-section. The combination of the mechanical coupling 130 and the thermal choke assembly 138 permits use of a turbomachine at extremely high temperatures without subjecting the motor, generator or alternator on the cool end C to temperatures exceeding the maximum operational temperatures for which they are rated.

As shown in FIG. 3, the hot end H is separated from the cool end C by the thermal choke assembly 138 that acts as a thermal barrier between the two sides of the machine 100. The thermal choke assembly 138 preferably comprises a hot end choke plate 140 (disposed adjacent to the hot side of the thermal barrier) and a cool end choke plate 142 (disposed adjacent to the cool side of the thermal barrier). Preferably, the choke plates 140 and 142 are mounted generally parallel to one another. More preferably, the choke plates 140 and 142 are preferably designed with thin cross-sections so as to facilitate quick heat dissipation. The plate designs cause heat to travel through the thin cross-sections for minimum heat conduction and maximum heat dissipation through natural convection. Accordingly, the thermal barrier formed by the thermal choke assembly 138 acts as a thermal choke to protect the cool end C of the turbomachine 100 and provide a significant temperature gradient across the hot end H and the cool end C of the turbomachine 100. Additionally, the structure of the thermal choke assembly 138, which dictates its heat suppression operation, also facilitates alignment of the cool end machine housing and its internal components in relation to the hot end machine housing so as to reduce potential stress on the mechanical coupling 130 should the hot end and cool end components be misaligned.

Heat generated in the hot end H of the turbomachine 100 may be transferred to the hot end choke plate 140 via all three modes of heat transfer—namely, convection, conduction and radiation. The dominant mode of heat transfer to the hot end choke plate 140 is conduction. Maximum heat is conducted to the hot end choke plate 140 at the junction where it meets a hot end machine housing, adjacent to the ducting 106. The majority of this heat then moves toward a transition portion 144 of the thermal choke assembly 138 disposed between the hot end choke plate 140 and the cool end choke plate 142. The heat that passes through the transition portion 144 moves on to the cool end choke plate 142. However, by the time the heat reaches the cool end choke plate 142, the temperature has already been significantly cooled down, for example by dissipation, natural convection and radiation heat transfer to the atmosphere. Therefore, the thermal choke assembly 138 creates a thermal barrier between the hot end H and the cool end C of the turbomachine 100 and protects the internal components of the machine 10 from premature failure.

Figure 5:
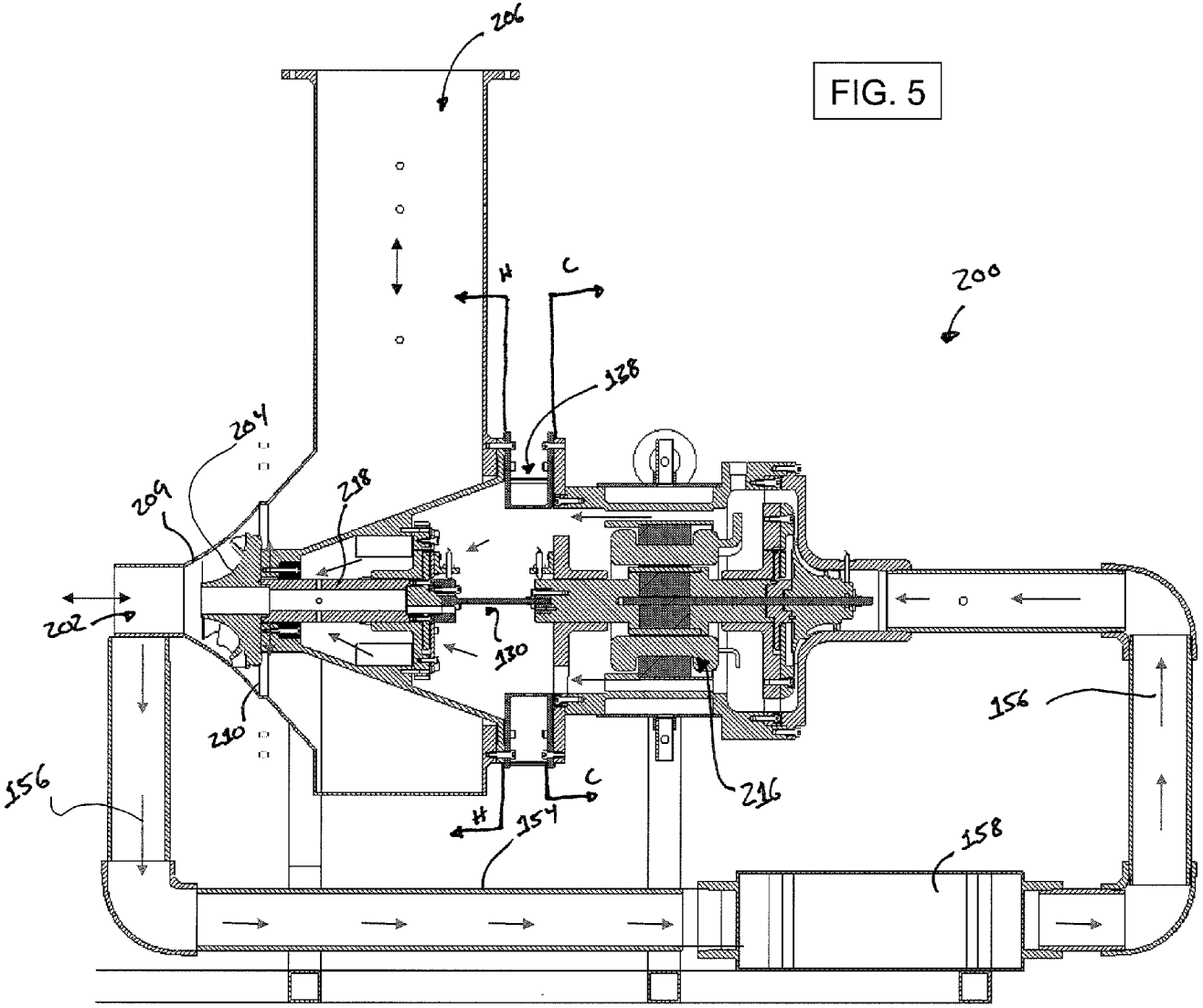
FIG. 5 shows a cross-sectional view of a centrifugal- or radial-type turbomachine embodying the present invention.

The working components of the turbomachine may include the general components of a known centrifugal- or radial-type blower or compressor design. For example, an exemplary blower design that can operate as a centrifugal machine driven by an electric motor or a radial turbine driving a generator or an alternator is described in copending U.S. Application Publication No. 2009/0087299 A1, assigned to the owner of the present invention and incorporated herein by reference. In such a design as shown in FIG. 5, the hot end H of a turbomachine 200 generally comprises a hot end rotating shaft 218 mounted therein for rotation about a longitudinal axis. A rotor device 204 (i.e., a centrifugal fan for a motor-driven blower or compressor design and a radial turbine impeller for a turbine-driven generator or alternator design) is mounted on the rotating shaft 218 relative to a volute 209 and a diffuser 210. The volute 209 includes an inlet associated with ducting 202 or 206 for the process gas to be processed, and an outlet associated with ducting 206 or 202 for discharging processed gas. In one configuration of the turbomachine 200, the volute inlet 202 is generally aligned with the central longitudinal axis of the turbomachine 200 while the volute outlet 206 is peripherally disposed. In alternate configurations, the inlet and outlet are reversed so that the process gas flow comes from the peripherally disposed ducting 206 and is discharged via the axially directed ducting 202. The diffuser 210 includes a plurality of low solidity vanes radially disposed on and about a diffuser plate. As is typical for the design of diffusers, the diffuser vanes are positioned around a central opening for mounting the diffuser around the rotating shaft 218 on which the rotor device 204 is mounted. The vanes are preferably cambered, air-foil shaped, permitting operation at low flow without surging. The vanes are also preferably flushed on the interior surface of the volute to avoid any flow leakage. The diffuser 210 has an inlet and an outlet generally corresponding to the volute inlet and volute outlet, respectively, to direct the flow of the process gas as it moves through the hot end H of the turbomachine 200.

Regardless of the components and design of the hot end H of a turbomachine in accordance with the present invention, all components on the hot end H must be able to withstand extreme temperatures.

Referring back to FIG. 2, the cool end C of the turbomachine 100 houses an electric component 116 for the machine, such as a motor, a generator, or an alternator. During operation of the machine 100 in accordance with the present invention, especially in view of the anticipated operation of the machine at extremely high temperatures—i.e., greater than about 850° C.—the cool end C must be appropriately cooled so as to protect and preserve the operational life of the components disposed therein, especially, the main electric component.

In addition to the main electric component housed therein, the cool end C comprises an electric component housing 146, the cool end rotating shaft 120, front and rear journal bearing assemblies 124 and the thrust bearing assembly 128. A cooling fan 148 mounted on the cool end rotating shaft 120 for rotation therewith raises the pressure of the inner core to drive a cooling flow, illustrated in FIG. 4, to pass through these internal components of the machine 100 to be cooled. In a motor-driven configuration of the present invention, the cool end rotating shaft 120 is driven by a motor 116. In a turbine-driven configuration of the present invention, the cool end rotating shaft 120 is driven by rotation of the hot end rotating shaft 118, whereby torque is transferred between the shafts via the mechanical coupling 130.

The motor 116 of the present invention may be a switched reluctance, induction or brushless DC permanent magnet motor. In general, the motor 116 comprises a motor rotor 150 mounted to or forming part of the cool end rotating shaft 120, and a motor stator assembly 152 disposed around the motor rotor 150 and press fitted into the electric component housing 146. In a preferred motor design, the motor rotor 150 includes a permanent magnet and the motor stator assembly 152 includes coils encircling the motor rotor 150 to operatively interact with the permanent magnet. Preferably, the motor 116 is controlled by a sensorless controller and/or an inverter (not shown), which can either be mounted on the electric component housing 146 or located along side of it. Thus, in a motor-driven configuration of the present invention, the turbomachine 100 gets its input power through the controller, which energizes the motor stator assembly 152, which in turn interacts with the motor rotor 150 to rotate the cool end rotating shaft 120 at desired high speeds.

In a turbine-driven configuration of the present invention, the electric component 116 comprises a generator or an alternator typically comprising a rotor 150 mounted to or forming part of the cool end rotating shaft 120, and a stator assembly 152 disposed around the rotor 150 and press fitted into the electric component housing 146. In operation, rotation of the turbine impeller 104 effects rotation of the hot end rotating shaft 118, which, via the mechanical coupling 130, drives the cool end rotating shaft 120. Upon rotation of the cool end rotating shaft 120, the rotor 150 also rotates. The rotational relationship between the rotor 150 and the stator assembly 152 converts the shaft work into electrical power, which can be withdrawn from the machine 100 through a power converter (not shown) and provided to any designated external machine, power storage unit, or the like.

Figure 4:
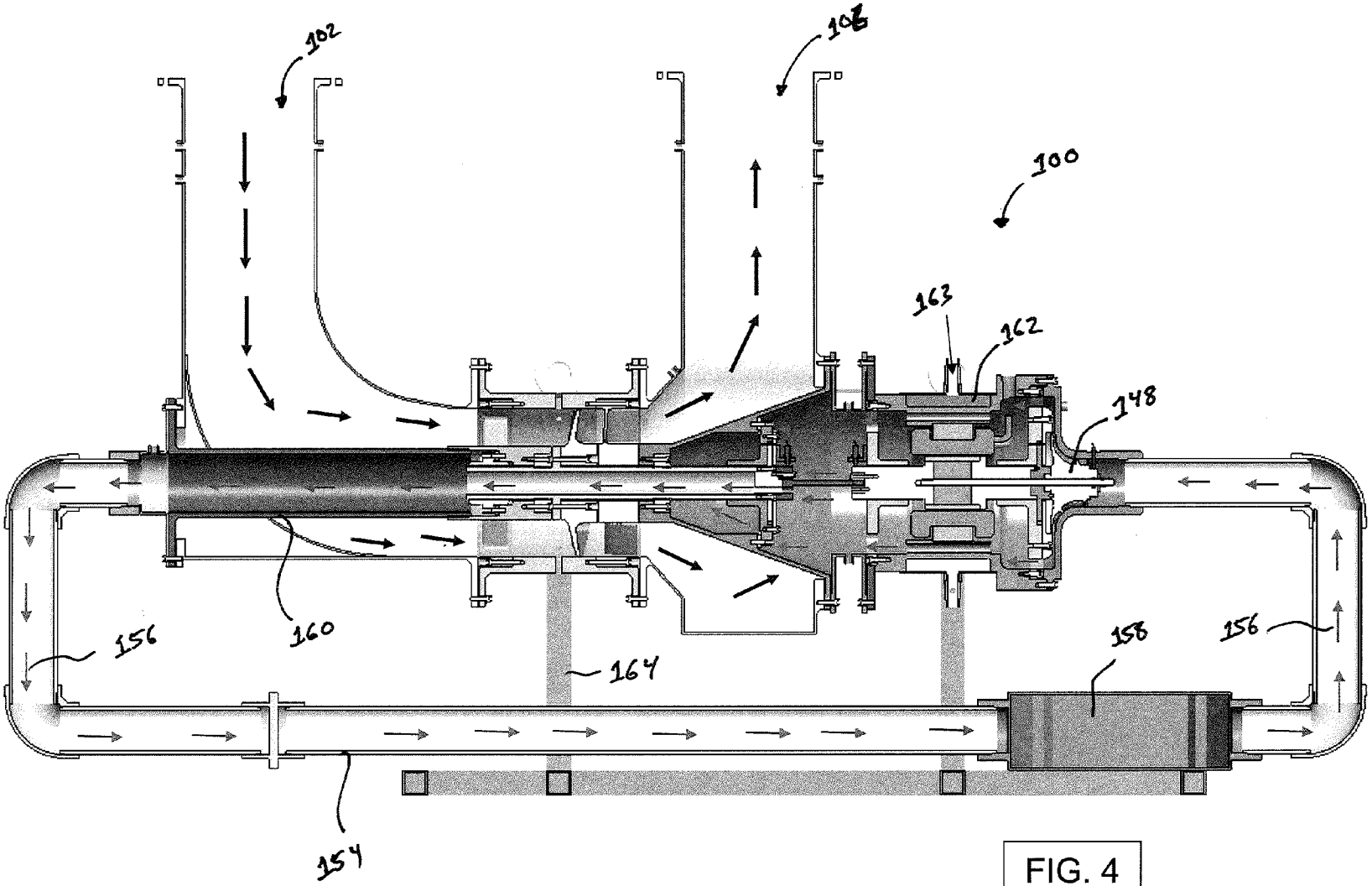
FIG. 4 illustrates a preferred cooling scheme for the turbomachine of FIG. 2 in accordance with the present invention.

Cooling of the internal components of the machine 100 is precisely controlled and utilizes process gas containing within the machine housings so that the machine design can remain hermetically-sealed, gas tight, and leak proof in accordance with desired specifications. As illustrated in FIG. 4, the cooling fan 148 on the end of the cool end rotating shaft 120 draws a small amount of process gas trapped inside the hot end housing through the hot end rotating shaft 118, the hot end rotor device 104, the hot end journal bearing assemblies 122, and the hot end thrust bearing assembly 126. This cooling circuit created by the cooling fan 148 also draws heat from components on the cool end C of the machine 100, such as the cool end rotating shaft 120, the cool end electric component 116, the cool end journal bearing assemblies 124, and the cool end thrust bearing assembly 126. This process gas is drawn out of the hot end housing via cooling pipes 154, in which the gas may be referred to as a "cooling circuit gas flow" 156. This cooling circuit gas flow 156 carries heat generated in both sides during operation of the turbomachine 100, as well as heat transferred from the process gas within the hot end H of the turbomachine 100.

As also shown in FIG. 4, the present invention preferably includes a heat exchanger 158 in operative communication with the machine 100 via the cooling pipes 156. The heat exchanger 158 aids in the cooling process and improves internal cooling of the machine components using only process gas cycled through the machine 100 and the heat exchanger 158 without compromising the hermetically-sealed design of the machine housing. Specifically, the heat carried by the cooling circuit gas flow 156 is lost or dumped outside of the machine through the heat exchanger 158, which can be cooled by water or any fluid that is at a lower temperature than the cooling circuit gas flow 156. The cooled gas is then drawn back into the machine 100, at the cool end C thereof, by the cooling fan 148 and forced through the machine 100 for continued cooling, via the cooling circuit illustrated in FIG. 4.

The entire machine assembly in accordance with the present invention may be mounted on a stand 164, where the cooling piping 154 and the heat exchanger 158 are provided in operative communication with the machine assembly and attached as necessary.

In operation of the turbomachine 100, once the inner core pressure of the machine equals the outlet pressure of the outlet ducting (e.g., 102 or 106), the controlled process gas leakage flow across the labyrinth seal 114 stops. The small amount of process gas trapped inside the inner core of both the hot end H and the cool end C of the machine 100 is constantly recirculated through the heat exchanger 158, in the manner discussed above, to cool the machine's critical components, such as the rotating shafts 118 and 120, the rotor device 104 of the hot end H, and the electric component 116 on the cool end C, and the journal and thrust bearing assemblies 122, 124 and 126, 128 in both ends.

A protective sleeve 160, generally having the form of an annulus ducting as shown in FIG. 2, may be provided to guide the flow of the hot process gas in the hot end H of the machine 100 over the hot end rotating assembly, including the hot end rotating shaft 118, journal bearing assemblies 122, and thrust bearing assembly 126. In operation, the protective sleeve 160 restricts the direct exposure of the hot end bearings to the harsh environment in the hot end H of the machine 100 caused by the high temperatures of the process gas therein. Additionally, the hot end rotating assembly may be cooled by forcing a cooling gas through the sleeve 160, thereby keeping the temperatures of the rotating shaft 118, the rotor device 104, and the bearings 122 and 126 below limit and increasing the operative life of such components.

With the combinations of heat suppression by the mechanical coupling 130 and the thermal choke assembly 138, as shown in FIG. 3, and the cooling circuit illustrated in FIG. 4, optimal thermal management of the turbomachine 100 of the present invention is achieved.

In an additional scheme of cooling the turbomachine 100, a small amount of the process gas in the inlet of the blower or compressor in a motor-driven configuration, or in the outlet of the turbine in a turbine driven configuration, may be used for continuously injecting cooling air through the hot end H to improve creep life of the hot end rotor device 104. Further, in accordance with another aspect of the present invention, a cooling jacket 162 may be formed in the cool end C of the machine 100 to cool the main electric component 116 of the machine 100—i.e., a motor, a generator, or an alternator—using a fluid, such as water, air or the like. This cooling jacket may also be used to convect stator heat from the machine. In FIG. 4, the in-flow for the cooling jacket is represented by reference numeral 163.

As noted above, a turbomachine can be designed in accordance with the present invention in various operational configurations. For example, the present invention can be configured as either an axial-type machine assembly, as generally shown in FIG. 2, or a radial-type machine assembly, as generally shown in FIG. 5. Similarly, the present invention can be a motor-driven turbomachine configuration, where the cool end rotating assembly drives the hot end rotating assembly via the mechanical coupling 130, or a turbine-driven turbomachine configuration, where the hot end rotating assembly drives the cool end rotating assembly via the mechanical coupling 130.

Referring back to FIG. 2, a configuration of the present invention may comprise an electric motor 116 on the cool end C of the machine driving an axial-type blower or compressor fan 104 on the hot end H of the machine 100 to raise the pressure of the process gas used therein. In this set-up, the ducting 102 acts as an inlet for the process gas, and the ducting 106 acts as an outlet for the pressurized process gas.

Conversely, a configuration of the present invention exemplified by the structure shown in FIG. 2 may alternatively comprise a generator or an alternator 116 on the cool end C of the machine driven by an axial turbine impeller 104 on the hot end H of the machine that extracts energy from pressurized high-temperature process gas and produces electricity. In this set-up, the ducting 106 acts as an inlet for the process gas, and the ducting 102 acts as an outlet for the process gas after it has been expanded by the turbine impeller 104.

Referring back to FIG. 5, a configuration of the present invention may comprise an electric motor 216 on the cool end C of the machine driving a centrifugal-type fan 204 on the hot end H of the machine 200, to raise the pressure of the process gas used therein. In this set-up, the ducting 202 acts as an inlet for the process gas, and the ducting 206 acts as an outlet for the pressurized process gas.

Conversely, a configuration of the present invention exemplified by the structure shown in FIG. 5 may alternatively comprise a generator or alternator 216 on the cool end C of the machine driven by a radial-type turbine impeller 204 on the hot end H of the machine. This configuration extracts energy from pressurized high-temperature process gas and produces electricity. In this set-up, the ducting 206 acts as an inlet for the process gas, and the ducting 202 acts as an outlet for the process gas that has been expanded by the turbine impeller 204.

In each of these embodiments, the compliant mechanical coupling 130 transmits the requisite torque between the hot end H and the cool end C of the machine 100 or 200, regardless of which end is the drive end and which end is the driven end. The mechanical coupling 130 is preferably designed as a splined-type with compliancy so that it can accommodate any misalignment between the hot end and cool end rotating assemblies. The mechanical coupling 130 preferably also permits axial movement of the respective rotating shafts 118 and 120 to let the hot end and the cool end rotating assemblies move independently to react to and accommodate thermal and dynamic loads exerted during operation. As a result, the mechanical coupling 130, under all operating conditions, allows uniform torque transformation.

High temperature capability is one of the core technical challenges of any turbomachine design for use in high temperature applications. Materials chosen for construction of the machines described herein are widely recognized materials for high-temperature applications. These materials permit even thermal growth in the system due to heat. This avoids warpage due to stressed joints and connections. The materials used are also preferably corrosion resistant at elevated temperatures. This allows any process gas to be used with the turbomachine configurations of the present invention, and as noted above, any such process gas selected can be used at extremely high temperatures without affecting operation of the machine.

The turbomachine configurations of the present invention address many of the concerns and drawbacks associated with prior art turbomachines in high-temperature operations by also using the technology of foil gas bearings that allow a sealed, contamination free, high-speed, efficient, self cooling system. As noted, both the hot end and the cool end of the turbomachines illustrated in FIGS. 2 and 5 preferably include foil gas journal bearings and foil gas thrust bearings. All bearings are oil free. The foil gas journal bearings sit inside journal bearing sleeves that are attached to the machine housing. The foil gas thrust bearings are positioned within the machine housing around a thrust runner. As so positioned, they are pinned and sandwiched between the stacked assembly comprising a journal bearing sleeve and the thrust runner. One thrust bearing is disposed about the thrust runner to operate in clockwise direction relative to the rotating assembly, while the other is disposed as a counterclockwise bearing relative to the rotating assembly.

Accordingly, in preferred embodiments of the present invention, pairs of foil-type hydrodynamic gas journal and thrust bearings support the hot end rotating shaft, and pairs of foil-type hydrodynamic gas journal and thrust bearings support the cool end rotating shaft. Alternatively, the present invention can be used for turbomachines supported on ceramic-type ball bearings or pressurized hydrostatic bearing without compromising design or operation of the turbomachine.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A turbomachine for processing a high-temperature gas, comprising:

(a) a hot end having a hot end housing for processing the gas flowing between an inlet and an outlet of the hot end housing, including:
  - a hot end rotating shaft mounted within the hot end housing for rotation about a central longitudinal axis;
  - a rotor device mounted on the hot end rotating shaft for rotation therewith;
  - at least one hot end journal bearing assembly radially supporting the hot end rotating shaft; and
  - a hot end thrust bearing assembly axially supporting the hot end rotating shaft;

(b) a cool end having an electric component housing and including:
  - a cool end rotating shaft mounted within the electric component housing for rotation about a central longitudinal axis;
  - an electric component comprising a rotor mounted for rotation with the cool end rotating shaft and a stator assembly mounted in stationary relationship with the electric component housing relative to the rotor;
  - at least one cool end journal bearing assembly radially supporting the cool end rotating shaft; and
  - a cool end thrust bearing assembly axially supporting the cool end rotating shaft; and (c) a compliant mechanical coupling connecting the hot end rotating shaft with the cool end rotating shaft to transfer operational torque between the respective rotating shafts and to suppress heat transfer from the hot end to the cool end.

2. The turbomachine of claim 1, further comprising a thermal choke assembly positioned between the hot end housing and the electric component housing for reducing heat transfer from the hot end to the cool end.

3. The turbomachine of claim 2, wherein said thermal choke assembly comprises:

- a hot end choke plate disposed adjacent to the hot end;
- a cool end choke plate disposed adjacent to the cool end; and
- a transition portion connected between the hot end choke plate and the cool end choke plate;

wherein heat transferred from the hot end is directed, in part, to the hot end choke plate through the transition portion and to the cool end choke plate; and wherein heat is dissipated from the thermal choke assembly as it passes from the hot end choke plate to the cool end choke plate.

4. The turbomachine of claim 1, wherein the electric component on the cool end comprises a motor that effects rotation of the cool end rotating shaft, which drives, via the compliant mechanical coupling, the hot end rotating shaft; and wherein the rotor device on the hot end comprises a fan that rotates with rotation of the hot end rotating shaft to pressurize process gas flowing between the inlet and the outlet of the hot end.

5. The turbomachine of claim 1, wherein the rotor device on the hot end comprises a turbine impeller that expands process gas flowing between the inlet and the outlet of the hot end, wherein rotation of said turbine impeller effects rotation of the hot end rotating shaft, which drives, via the compliant mechanical coupling, the cool end rotating shaft; and wherein electric component on the cool end comprises one of a generator and an alternator, and rotation of the rotor relative to the stator assembly generates electrical energy.

6. The turbomachine of claim 1, further comprising a cooling circuit path where process gas is recirculated and guided through or over internal components of the turbomachine for thermal management, said internal components including at least one of the hot end rotating shaft, the hot end rotor device, the hot end journal bearing assembly, the hot end thrust bearing assembly, the cool end rotating shaft, the cool end electric component, the cool end journal bearing assembly and the cool end thrust bearing assembly.

7. The turbomachine of claim 6, wherein said cool end further comprises a cooling fan mounted on the cool end rotating shaft for rotation therewith, wherein rotation of said cooling fan draws a portion of the process gas through the hot end and the cool end to cool internal components of the turbomachine.

8. The turbomachine of claim 7, wherein the turbomachine is operatively connected with a heat exchanger via cooling piping, whereby heat absorbed within the turbomachine is exhausted out of the turbomachine through the heat exchanger.

9. The turbomachine of claim 6, further comprising a cooling jacket formed in the electric component housing for cooling the electric component with a fluid flow.

10. The turbomachine of claim 6, further comprising a protective sleeve mounted on the hot end around at least one of the hot end rotating shaft, the hot end journal bearing assembly, and the hot end thrust bearing assembly for guiding the flow of the process gas in the hot end over said hot end internal components while restricting direct exposure of said internal components to the process gas.

11. The turbomachine of claim 1, wherein the compliant mechanical coupling comprises a splined coupling having a first end secured to the hot end rotating shaft, a second end secured to the cool end rotating shaft, and an intermediate section disposed between the first and second ends.

12. The turbomachine of claim 11, wherein the intermediate section of the splined coupling suppresses heat transfer from the hot end rotating shaft to the cool end rotating shaft.

13. A hermetically-sealed turbomachine having a drive end and a driven end for handling a high-temperature process gas, said turbomachine comprising:

a hot end taking the form of one of a blower, a compressor and a turbine, said hot end including a hot end housing and a hot end rotating assembly mounted within the hot end housing to handle the process gas between an inlet and an outlet;

an electric component end taking the form of one of a motor, a generator and an alternator maintained at a relatively lower temperature than the hot end, said electric component end including an electric component end housing and an electric component end rotating assembly mounted within the electric component end housing that drives or is driven by the hot end rotating assembly;

a compliant mechanical coupling connecting the hot end rotating assembly with the electric component end rotating assembly; and a thermal choke assembly disposed between the hot end housing and the electric component end housing, wherein said thermal choke assembly is stationary relative to the rotating assemblies of the hot end and the electric component end;

wherein the mechanical coupling and the thermal choke assembly collectively suppress heat transfer from the hot end to relatively lower temperature electric component end.

14. The turbomachine of claim 13, wherein the electric component end takes the form of a motor that effects rotation of the electric component end rotating assembly, which drives, via the compliant mechanical coupling, the hot end rotating assembly; and wherein the hot end takes the form of a compressor comprising a fan that rotates with rotation of the hot end rotating assembly to pressurize process gas flowing between the inlet and the outlet of the hot end.

15. The turbomachine of claim 13, wherein the hot end takes the form of a turbine comprising an impeller that expands process gas flowing between the inlet and the outlet of the hot end, wherein rotation of said impeller effects rotation of the hot end rotating assembly, which drives, via the compliant mechanical coupling, the electric component end rotating assembly; and wherein the electric component end takes the form of one of a generator and an alternator, whereby rotation of the electric component rotating assembly generates electrical energy.

16. The turbomachine of claim 13, wherein said thermal choke assembly comprises:

a first choke plate disposed adjacent to the hot end;

a second choke plate disposed adjacent to the electric component end; and a transition portion connected between the first choke plate and the second choke plate;

wherein heat transferred from the hot end is directed, in part, to the first choke plate through the transition portion and to the second choke plate; and wherein heat is dissipated from the thermal choke assembly as it passes from the first choke plate to the second choke plate.

17. The turbomachine of claim 13, further comprising a recirculating cooling circuit defined by a cooling circuit path where process gas is recirculated and guided through or over the hot end rotating assembly and the electric component end rotating assembly.

18. The turbomachine of claim 17, wherein the electric component end includes a cooling fan mounted to the electric component rotating assembly for rotation therewith, wherein rotation of said cooling fan draws a portion of the process gas through the hot end and the electric component end to cool internal components of the turbomachine.

19. The turbomachine of claim 18, wherein the turbomachine is operatively connected with a heat exchanger via cooling piping, whereby heat absorbed within the turbomachine is exhausted out of the turbomachine through the heat exchanger.

20. The turbomachine of claim 17, further comprising a cooling jacket formed in the electric component end housing for cooling an electric component disposed therein with a fluid flow.

21. The turbomachine of claim 17, further comprising a protective sleeve mounted on the hot end around the hot end rotating assembly for guiding the flow of the process gas in the hot end over said hot end rotating assembly while restricting direct exposure of said hot end rotating assembly to the process gas passing between the inlet and the outlet of the hot end.

22. The turbomachine of claim 13, wherein each of the hot end rotating assembly and the electric component end rotating assembly is supported on at least one of hydrodynamic foil gas bearings, hydrostatic bearings, or oil-free ceramic-type ball bearings.

23. A recirculation cooling method for a turbomachine using the process gas of the turbomachine, wherein said turbomachine comprises a hot end taking the form of one of a blower, a compressor and a turbine, said hot end including a hot end rotating assembly mounted within a hot end housing to handle the process gas between an inlet and an outlet, and a cool end taking the form of one of a motor, a generator and an alternator, said cool end including a cool end rotating assembly mounted within a cool end housing that drives or is driven by the hot end rotating assembly, said cooling method comprising:

providing a cooling circuit path for guiding the process gas over the hot end rotating assembly and the cool end rotating assembly;

drawing the process gas through the cooling circuit path using a cooling fan mounted on the cool end rotating assembly for rotation therewith; and suppressing heat transfer from the hot end to the cool end of the turbomachine using a thermal choke assembly disposed between the hot end housing and the cool end housing.

24. The cooling method of claim 23, wherein the heat transfer between the hot end and the cool end of the turbomachine is suppressed by a compliant mechanical coupling connecting the hot end rotating assembly with the cool end rotating assembly.

25. The cooling method of claim 23, said method further comprising providing a heat exchanger in operative communication with the turbomachine via cooling piping to achieve thermal management of the process gas drawn through the cooling circuit path by dissipated heat and directing a cooled gas flow to the cooling fan.

* * * * *